US005722186A

United States Patent [19]

Brown

[11] Patent Number: 5,722,186

[45] Date of Patent: Mar. 3, 1998

[54] ORTHOTIC INSERT HAVING ADJUSTABLE ANGULAR ORIENTATION

[75] Inventor: Dennis N. Brown, Custer, Wash.

[73] Assignee: Northwest Podiatric Laboratory, Inc., Blaine, Wash.

[21] Appl. No.: 714,525

[22] Filed: Sep. 16, 1996

Related U.S. Application Data

[63] Continuation of Ser. No. 240,089, May 9, 1994, abandoned, which is a continuation of Ser. No. 93,133, Jul. 16, 1993, abandoned, which is a continuation of Ser. No. 836,180, Feb. 12, 1992, abandoned, which is a continuation of Ser. No. 482,025, Feb. 16, 1990, abandoned.

[51] Int. Cl.[6] ..... A43B 13/38

[52] U.S. Cl. ..... 36/43; 36/140

[58] Field of Search ..... 36/140–182, 3 B, 36/43, 44, 81, 71, 37; 128/581, 584, 595, 614, 619, 621

[56] References Cited

U.S. PATENT DOCUMENTS

| | | | |
|---|---|---|---|
| 832,325 | 10/1906 | Gordon | 36/37 |
| 862,091 | 7/1907 | Miller | 36/37 |
| 901,236 | 10/1908 | Gordon | 36/37 X |
| 933,551 | 9/1909 | Gordon | 36/37 |
| 959,513 | 5/1910 | Gordon | 36/37 |
| 1,721,714 | 7/1929 | Ross | 36/37 |
| 1,811,641 | 6/1931 | Marcelle | 36/146 |
| 2,500,591 | 3/1950 | Watkins et al. | 36/37 X |
| 2,722,063 | 11/1955 | Drefvelin | 36/3 B |
| 2,865,097 | 12/1958 | Vollrath, Jr. et al. | 36/37 X |
| 3,585,737 | 6/1971 | Gilkerson | 36/43 |
| 3,601,908 | 8/1971 | Gilkerson | 36/43 |
| 3,952,427 | 4/1976 | von den Benken et al. | 36/43 X |
| 4,168,585 | 9/1979 | Gleichner | 36/173 X |
| 4,187,621 | 2/1980 | Cohen | 36/44 |
| 4,250,886 | 2/1981 | Riso et al. | 128/621 |
| 4,317,293 | 3/1982 | Sigue et al. | 36/43 |
| 4,320,588 | 3/1982 | Sottolana | 36/43 X |
| 4,530,173 | 7/1985 | Jesinsky, Jr. | 36/81 X |
| 4,571,857 | 2/1986 | Castellanos | 36/154 X |
| 4,619,056 | 10/1986 | Lin et al. | 36/37 X |
| 4,718,179 | 1/1988 | Brown | 36/44 |
| 4,727,661 | 3/1988 | Kuhn | 36/43 X |
| 4,776,109 | 10/1988 | Sacre | 36/37 X |
| 4,800,657 | 1/1989 | Brown | 36/44 |
| 4,823,420 | 4/1989 | Bartneck | 36/44 X |
| 4,879,821 | 11/1989 | Graham et al. | 36/140 X |
| 4,897,937 | 2/1990 | Misevich et al. | 36/43 |

FOREIGN PATENT DOCUMENTS

| | | | |
|---|---|---|---|
| 129477 | 4/1946 | Australia | 36/102 |
| 509405 | 11/1920 | France | 128/619 |
| 1216879 | 4/1960 | France | 36/3 B |
| 1114407 | 4/1961 | Germany | 36/3 |
| 2136671 | 9/1984 | United Kingdom | 36/43 |

*Primary Examiner*—B. Dayoan
*Attorney, Agent, or Firm*—Todd N. Hathaway

[57] ABSTRACT

An orthotic insert adapted to be placed within a shoe having an insole. The orthotic insert has a relatively rigid, resilient base member having a heel portion and an arch portion. The upper surface of the base member is contoured to fit the plantar surface of a person's foot, so as to position the foot in a generally desired angular orientation. At least one curvilinear ridge is formed on the lower surface of the base member, and extends continuously around the rearward end of the heel portion and along the arch portion on both sides of the longitudinal axis of the orthotic insert. The ridge has a sharp lower edge which projects downwardly from the lower surface of the base member for supporting the heel seat in the heel section above the insole when the orthotic insert is placed within the shoe. The lower edge of the ridge is adapted to have material incrementally removed therefrom so that the angular orientation of the foot can be adjusted to suit an individual person. The sharp lower edge of the ridge penetrates into the upper surface of the insole to maintain the insert in position, when the person's weight is applied to the upper surface of the orthotic insert.

27 Claims, 7 Drawing Sheets

FIG. 15
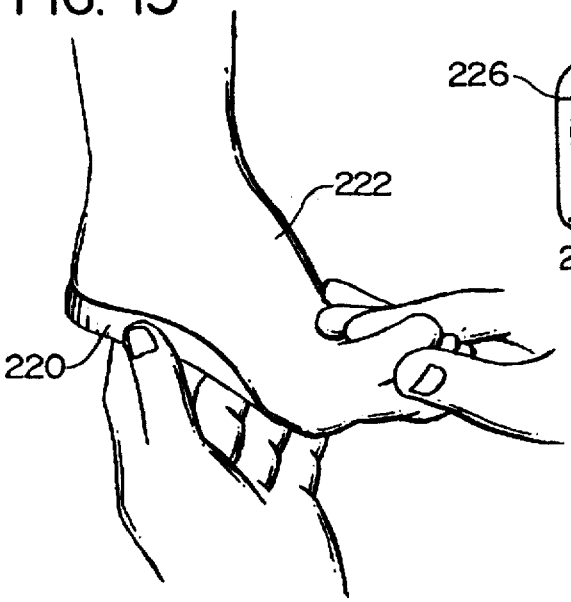
FIG. 16
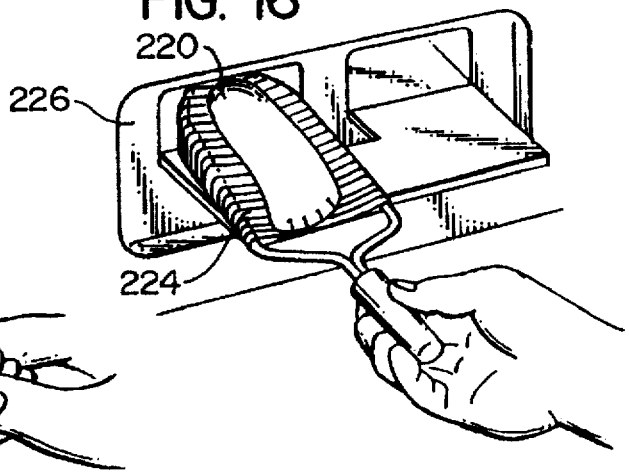
FIG. 17
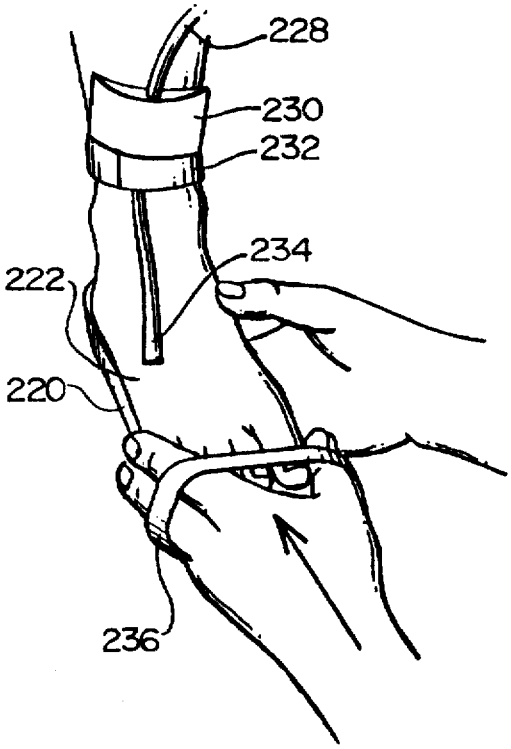
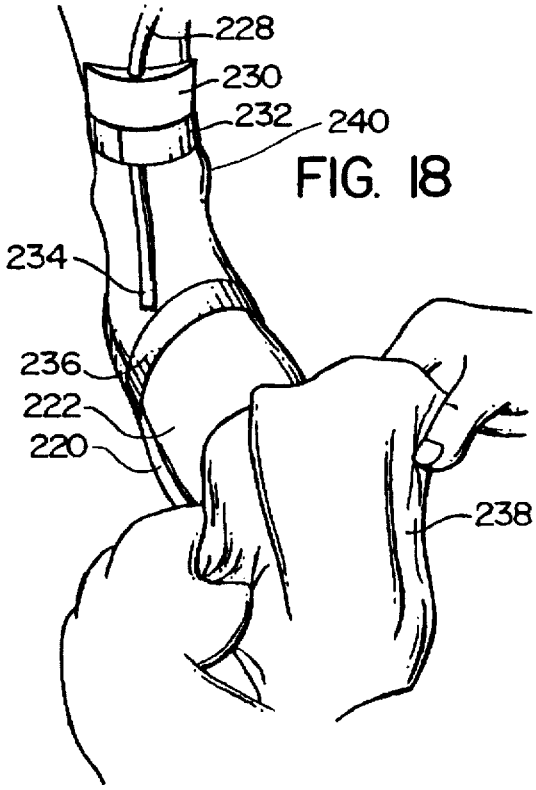
FIG. 18

ORTHOTIC INSERT HAVING ADJUSTABLE ANGULAR ORIENTATION

This is a continuation of application Ser. No. 08/240,089 filed on May 9, 1994, now abandoned, which is a con. of Ser. No. 08/093,133 filed Jul. 16, 1993, now abandoned, which is a con. of Ser. No. 07/836,180 filed Feb. 12, 1992, now abandoned, which is a con. of Ser. No. 07/482,025 filed Feb. 16, 1990, also abandoned.

BACKGROUND OF THE INVENTION

1. Field of the Invention

This invention relates generally to orthotic appliances. More particularly, the present invention relates to an improved orthotic insert for shoes which is adjustable to suit the needs of an individual person and which is arranged and adapted to be made by a relatively convenient and rapid process.

2. Background Art

Fairly recently, greater attempts have been made to provide footwear which is anatomically correct so as to not only increase the comfort of the wearer, but also to minimize fatigue and injuries. This requires an analysis of the typical human gait. When one is moving substantially in a single linear direction, the gait consists of three distinct phases. First, the heel strike phase occurs, during which the foot is essentially a "mobile adapter" ready to conform to the irregular topographical contours which may be encountered. Second, the transition or mid-gait phase transforms the mobile adapter into a "rigid lever" where the mid tarsal joint becomes locked, preparing the foot for translation of the accumulated forces in a stable manner throughout the foot during the remainder of the cycle, and the impact forces are dissipated through the ankle and leg bones to the upper torso. Third, the "toe roll" phase finishes the gait cycle and the next step is begun. The critical phase is the mid-gait or transition phase where the foot is transformed from a "mobile adapter" to a "rigid lever". The optimum configuration for the ankle at this point is to have a subtalar joint in a neutral position as the mid tarsal joint becomes locked and the foot becomes a rigid lever. This allows the impact load to properly dissipated.

The range of motion of the subtalar joint is typically about 30 degrees. This range of motion is unequally centered or focused at the joint's "neutral position", at a point within the "mean" of the motion rather than at either extreme of the motion. From the ideal "neutral" functional position, the joint can rotate approximately twice as far in the direction of pronation (arch raising) as the joint can move in the direction of supination (arch lowering). Ideally, the joint should function close to its neutral position with mild fluctuations in the directions of pronation and supination as necessitated by the mechanical needs of the foot and leg. In the ideal foot, when the subtalar joint is in its neutral position, the posterior aspect of the calcaneus (heel bone) is perpendicular to the floor. Most feet, however, are aberrant from this accepted norm. For example, when the common foot is in its neutral position, the posterior surface of the calcaneus may actually rest inverted relative to the floor; i.e., the bottom of the heel bone faces more towards the mid-line of the body, and/or the distal (lowest) portion of the posterior surface of the calcaneus is closer to the mid-line of the body relative to the more proximal (upper) portion of the calcaneus. As noted above, it is generally desirable, whenever possible and practical, to make the subtalar joint function around its neutral position because of foot stability, balance, and shock absorption.

When the subtalar joint is in its neutral position, the next distal joint—the mid tarsal joint—"locks" to effectively stabilize the foot into a rigid lever, which is the ideal position for both the majority of weight bearing and active propulsion. However, if the subtalar joint is excessively pronated from its neutral position, the mid tarsal joint cannot be stabilized, and in essence the mid tarsal joint "unlocks", rendering the foot mobile, flattened, and incapable of efficient active propulsion.

It is, therefore, clear that whenever possible, the subtalar joint should be positioned in or close to its neutral position because of its direct effect on the mid tarsal joint. Additionally, by initially positioning the subtalar joint near its neutral position and away from its extremes of motion (especially in the direction of pronation), it permits the joint divisional latitude to move in either direction (pronation or supination), as the demands of body stability and function necessitate.

Style shoes, such as high-heeled shoes which are worn by many women in contemporary society, place many demands on the foot of the user, principally because the foot is forced to function in an unusual position. The human foot was designed to walk on an essentially flat surface, although, as noted above, the foot has the latitude and ability to adapt to irregular terrain.

In a style shoe, the foot is forced to walk on irregular terrain as if the foot were constantly walking downhill. The ankle is plantar flexed (foot down) forcing the user to walk on the ball of the foot or "tiptoes". The plantar flexed positioning causes the whole rear-foot to invert (i.e., tilt inwardly), causing the calcaneus (heel bone) to function in an inward tilting manner. Additionally, this plantar flexed position of the foot causes an increase in the height of the arch. It is because of this positional change that many styled shoes are made with a higher shank (arch curve) within the shoe. Still further, when the rear foot is inverted, the fourth and fifth metatarsal heads may be drawn upwardly, so as to not receive support in the toe end of the shoe.

Postural complications resulting from use of styled shoes include foot and ankle instability, and excessive weight-bearing on the ball of the foot. The consequences of this complication include foot and ankle sprains, arch fatigue, corns, callouses, and generalized fatigue and pain in the ball of the foot. Attempts to fabricate rigid or semi-rigid foot orthoses have met with limited success because increased curves from heel through the shank and onto the forefoot of the shoe are excessive. This causes the foot devices to move back and forth since the curve of the shank within the shoe is greater than the external curve of the foot device. Furthermore, styled shoes by their design and nature are very tight-fitting, leaving little room for the added bulk of the device.

In normal gait, as noted above, the foot is biphasic. At heel contact, the foot is mobile so that it can adapt to the irregularities of the terrain. Shortly thereafter, the foot begins converting to the rigid lever, thereby imparting stability and rigidity to the foot. The conversion of the mobile adapter to the rigid lever occurs because the motion and position of the subtalar joint interacts with the motion and position of the midtarsal joint. When the foot is placed within the confines of a style shoe, it is immobilized in an abnormal position, and the normal motions between the joints of the foot are impaired or stopped. Stability consequently must be obtained by positioning the joints and not by motion within the joint. Thus, to obtain proper stability of the foot within the style shoe, the joints of the foot should be correctly positioned. Accordingly, there exists a need for an orthotic for use in style shoes which optimizes, supports, and maintains the correct positions of the joints of the foot.

Furthermore, while podiatrists have long been aware of the need to maintain the foot's proper orientation relative to the leg to provide a "rigid lever" and, accordingly, have prescribed orthotics for that purpose, the general populace rarely avails themselves of these specialist services until after a certain amount of discomfort and/or damage has been done. Accordingly, there exists a need for an inexpensive orthotic, which the general population may readily avail themselves of, and for such an orthotic which can be easily modified or adjusted by the purchaser to "fine tune" the insert to accommodate the wearer.

The following patents reflect the state of the art of which Applicant is aware, insofar as these references appear to be germane to the patent process:

| U.S. Pat. No. | Patentee | Issue Date |
|---|---|---|
| 4,800,657 | Brown | January 31, 1989 |
| 4,727,661 | Kuhn | March 1, 1988 |
| 4,718,179 | Brown | January 12, 1988 |
| 4,619,056 | Lin et al. | October 28, 1986 |
| 4,320,588 | Sottolana | March 23, 1982 |
| 3,952,427 | von den Benken et al. | April 27, 1976 |
| 3,601,908 | Gilkerson | August 31, 1971 |
| 2,865,097 | Vollrath Jr. et al. | December 23, 1958 |
| 2,500,591 | Watkins et al. | March 14, 1950 |

Of these, the Brown '657 and Brown '179 patents (the inventor in each of these cases being the same as the Applicant herein) appear to be of the greatest interest since they teach orthotic inserts which are capable of adjustment which adapt the insert to the unique physical conformation of the wearer's foot.

Brown '657 discloses an orthotic appliance which is formed initially as a blank having an upper surface that generally follows the contour of the plantar surface of the foot; thereafter, resilient fingers disposed within certain areas on the bottom of the appliance, and certain plugs, are adapted to beneficially distort the upper surface contour of the insert so as to provide an identical correspondent with the plantar surface of the user's foot, and in addition to provide beneficial angulation of the foot as may be desired.

Brown '179 discloses an orthotic which is provided with a relatively rigid cap made of a material which, at a moderately elevated temperature, can take a permanent deformation which then becomes fixed at a lower temperature, and a relatively flexible blank member configured to fit beneath and engage a plantar surface of the user's foot. The rigid cap is heated to the elevated temperature, and then the blank is fitted against an upper surface of the cap. The cap and the blank are placed against the plantar surface of the foot while the cap is at the elevated temperature, and a substantially uniform pressure is applied against an outer surface of the cap so as to cause the cap to assume a configuration and contour matching the plantar surface of the foot. The underside of the orthotic is provided with a plurality of individual stabilizing elements, the undersides of which can be ground off to predetermined depths so as to change the tilt or angular position of the heel portion of the orthotic by desired increments in numbers of degrees.

The devices taught in Brown '657 and Brown '179 are each highly effective for the uses for which they are intended; both of these, however, are particularly suitable for use by a trained professional, such as a podiatrist, having both the skill and equipment to determine the correct alignment adjustments for an individual foot, and to then effect the prescribed modifications to the orthotic devices. Furthermore, while the devices disclosed in Brown '657 and Brown '179 are relatively inexpensive for a professionally prepared orthotic, they are nevertheless somewhat more complex and expensive to manufacture than may be desirable for orthoses of which the general public would avail itself in the retail market; as noted above, the general public frequently defers relatively expensive professional treatment until significant discomfort and/or damage has occurred.

The remaining references show the state of the art further: Kuhn discloses a removable insole having nubs and magnetic metal parts on its upper surface, and snap fasteners for fastening the insole to the sole of the shoe. Lin et al. disclose an insole fabricated from a resilient material and having a plurality of generally laterally extending cushioning ridges integrally formed on the surface of the cushioning layer opposite the foot supporting surface. Sottolana discloses a shoe bottom profiled so that it has a depression in its rear part for the heel of the foot; the thickness of the shoe bottom decreases gradually from the heel towards the front of the shoe. Von den Benken et al. disclose an insole for use in the manufacture of shoes which has several lower protrusions which fit into correspondingly disposed cavities in the outer sole of the shoe, so as to correctly align the outer sole and the insole at assembly. Gilkerson discloses a precast or molded insole for use with several heights of high heels, which includes a main body, a first fiberboard member bonded to the bottom of the main body and formed to receive a steel shank, and a second fiberboard member bonded to the main body above the first fiberboard member for nailing purposes. Vollrath et al. disclose a lining for the inner sole of the shoe which is provided with adhesive material on its underside so that one face may adhere to the inner sole. Watkins et al. disclose an arch support for shoes of the backless type, which includes an envelope which is slid over the rear end of the arch support and which is provided with a resilient checkered cushion to frictionally engage the surface of the arch support when it is slipped in, and an outer surface of the cushion frictionally holds to the heel section of the sole to prevent the arch support from slipping out of the shoe.

SUMMARY OF THE INVENTION

The present invention solves the cited problems, and comprises an orthotic insert having a forward to rear lengthwise axis and adapted to be placed within a shoe having an insole having an upper surface. The orthotic insert comprises a relatively rigid, resilient base member having a rearwardly located heel portion forming a concave heel seat, and a longitudinally extending curved arch portion. The base member has a lower surface and an upper surface, the upper surface being generally contoured to fit a plantar surface of a person's foot, so as to position the foot in a generally desired angular orientation. At least one curvilinear ridge is formed on the lower surface of the base member and extends substantially continuously around the rearward end of the heel portion, and along the arch portion on both sides of the longitudinal axis of the base member. The ridge has a lower edge which projects downwardly from the lower surface of the base member for supporting the heel seat above the insole when the orthotic insert is placed within a shoe so that the ridge rests on the insole. The lower edge of the ridge is adapted to have material incrementally removed therefrom so that the angular orientation of the foot can be adjusted to suit an individual person.

The lower edge of the ridge forms a sharply pointed lower edge for penetrating into the upper surface of the insole so as to maintain the insert in a longitudinally fixed position in the shoe when weight is applied to the upper surface of the base member by the foot of a person. The at least one ridge may comprise outer and inner substantially parallel, spaced apart ridges, one ridge projecting, downwardly a greater distance from the lower surface of the heel portion of the base member than the other ridge.

The orthotic insert may be placed in a style shoe having an insole having a relatively steeply downcurved arch portion which plantarflexes the foot of the wearer. The outer U-shaped ridge may project downwardly from the lower surface of the heel portion of the base member of the insert by a greater distance than does the inner ridge, so that the heel portion is stabilized against side-to-side rocking in the style shoe. The insert may also comprise a forwardly located forefoot portion having an upper surface for supporting the forefoot of the person, and a lower surface. A pair of spikes may be formed on the lower surface of the forefoot portion, each spike having sharply pointed lower end for penetrating into the upper surface of the insole so as to maintain the forefoot portion of the orthotic insert in a longitudinally fixed position in the style shoe.

The curved arch section of the base member may have a curvature which exceeds that of the curved arch portion of the insole of the style shoe, so that a gap is formed intermediate the lower surface of the base member in the upper surface of the arch portion of the insole. The base member may have thickened portions intermediate the parallel ridges in the arch portion, for providing the arch portion with relatively greater strength and resilience to flexing.

There is also an orthotic insert for installation in a normal shoe, in which case the inner ridge projects downwardly from the lower surface of the heel portion of the base member by a greater distance than does the outer ridge, so as to permit side-to-side rocking of the heel portion when the orthotic insert is placed within a normal shoe.

The orthotic inserts may be formed of injection molded plastic. A relatively resilient top cover may be mounted to the upper surface of the base member. The top cover may be fabricated separately from the base member and then attached thereto by adhesive. Alternatively, the base member may be formed and then placed within a second mold, and the resilient top cover injected molded therein directly on the upper surface of the base member.

Other features of the present invention will become apparent from the detailed description.

BRIEF DESCRIPTION OF THE DRAWINGS

FIGS. 15 through 19 are isometric views illustrating a sequence of steps in fitting an orthotic according to the present invention to a person's foot.

DETAILED DESCRIPTION OF THE INVENTION

Figure 1:
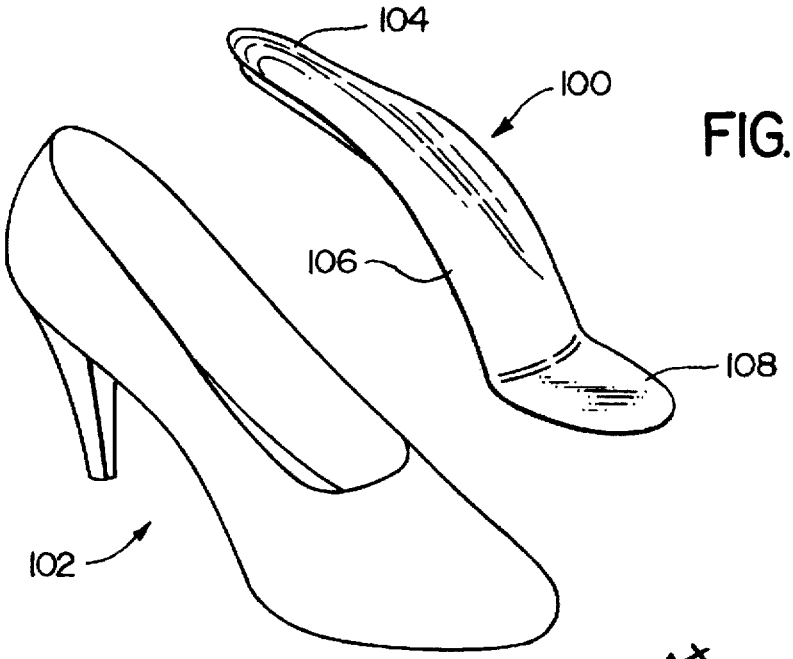
FIG. 1 is a perspective view of an orthotic according to the present invention, and a shoe for the installation of the orthotic therein.

Referring to the drawings now, reference numeral 100 is directed to a base member forming an orthotic insert according to the present invention. Orthotic 100, in the embodiment illustrated in FIG. 1, is adapted to be applied or installed in a shoe 102, so that orthotic 100 will lie against the sole of the shoe 102, intermediate the sole of the shoe and the plantar surface of the wearer's foot. The term "shoe", as used in this description and the appended claims, includes all suitable types of footwear, including boots, shoes, sandles, and the like. Shoe 102 is, in the case of orthotic 100 shown in FIG. 1, a woman's style shoe, i.e., a high-heeled shoe.

Orthotic insert 100 includes a semiplanar heel portion 104, a curved arch support section, 106, and a generally planar forefoot section 108.

Figure 2:
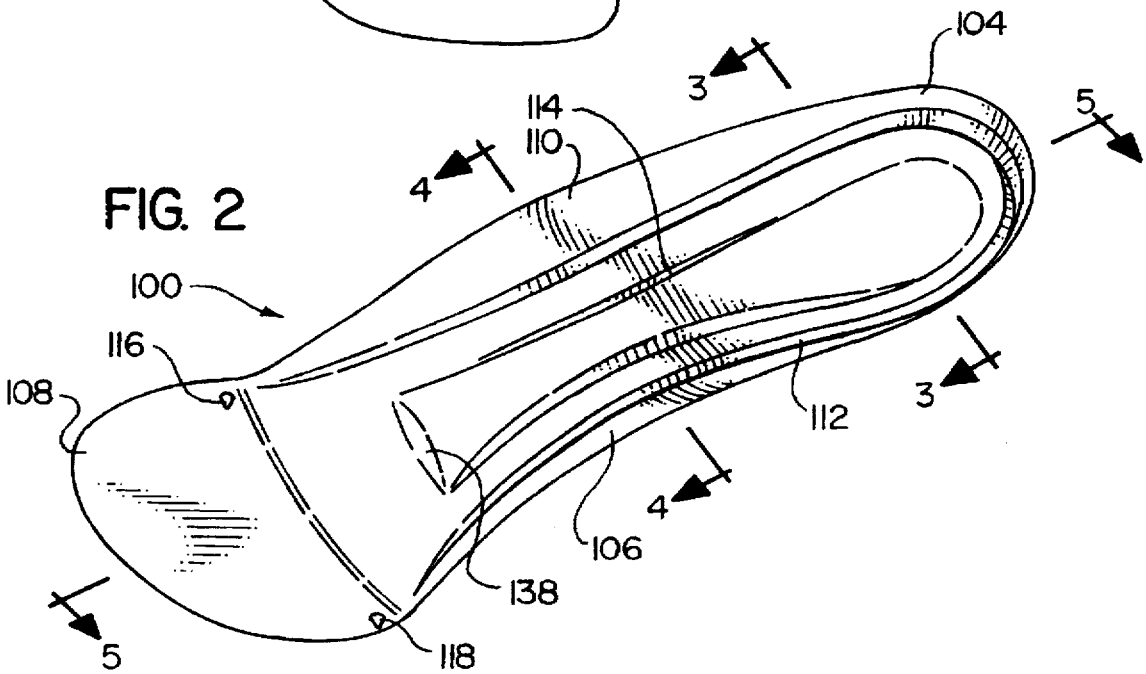
FIG. 2 is an isometric view the orthotic of FIG. 1, with the view being taken from a location looking from the side and upwardly toward the bottom surface of the orthotic.

FIG. 2 shows the lower side of orthotic 100. Orthotic insert 100 shown in FIG. 2 is intended for the right foot of a user; consequently, the inner arch support portion of orthotic 100 is in the area indicated by reference numeral 110.

The lower side of orthotic insert 100 is provided with a pair of ridges—outer ridge 112 and inner ridge 114—which are formed integrally with insert 100 which extend down both sides of orthotic insert 100 and completely around the heel section 104 thereof, so as to form a U-shaped pattern about the underside of heel section 104. The purposes and advantages of ribs 112 and 114 will become apparent from the description provided below.

As noted above, curved arch section 106 extends between heel section 104 and forefoot section 108 of orthotic insert 100. When orthotic insert 100 is inserted in a typical style shoe 102, the insert may have a tendency to slide downwardly in the shoe. A pair of teats or spikes 116 and 118 are consequently provided near the rearward edge of forefoot section 108, which dig or penetrate into the upper surface of the insole of the shoe under the weight of the user's foot, preventing the forefoot section 108 from slipping forward, and thus preventing the remainder of orthotic insert 100 from sliding downwardly within the shoe; spikes having a length of approximately 1/16 inch have been found to be eminently suitable for use in style shoes having typical insoles.

Orthotic insert 100 may be constructed from any suitable material, preferable either a semi-rigid or rigid material. For example, suitable materials may include various plastics which can be molded under pressure or under injection, including injection nylons, injection polyethylenes, graphite composites, thermal plastics, or the like. Injection molded plastics may be particularly suitable in terms of strength and low cost. Thermal plastics may be particularly desirable if the orthotic insert is to be heat molded, as will be described below with reference to FIGS. 15 through 20.

Figure 3:
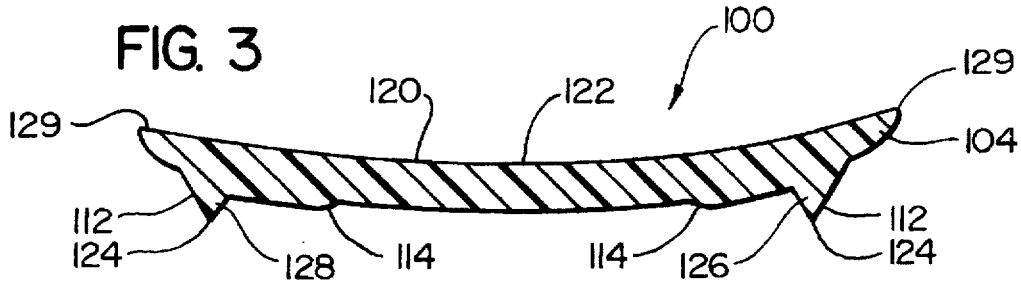
FIG. 3 is an end view of a section of the orthotic of FIG. 2, taken along line 3—3.

Attention is now directed to FIG. 3, which shows an end view of section through the heel section 104 of orthotic insert 100. As noted above, the upper surface of orthotic insert 100 in this area is semi-planar and slightly concave, so as to form a heel seat 120, which has a center point in the area generally indicated by reference numeral 122.

Figure 10:
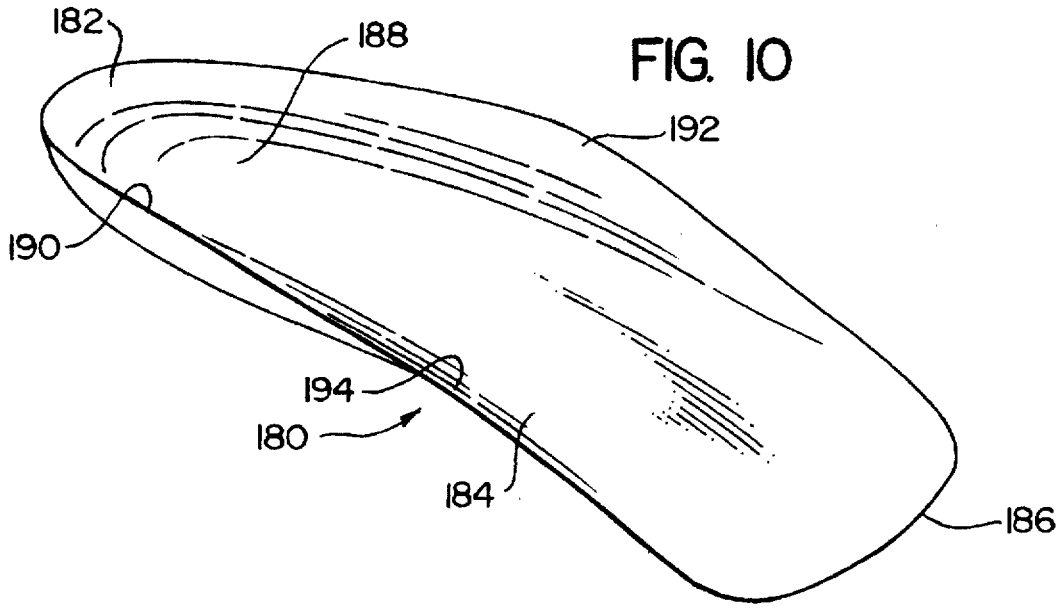
FIG. 10 is an isometric view of an orthotic according to a third preferred embodiment of the present invention, With the view being taken from a location looking from the side and downwardly toward the top surface of the orthotic.
Figure 11:
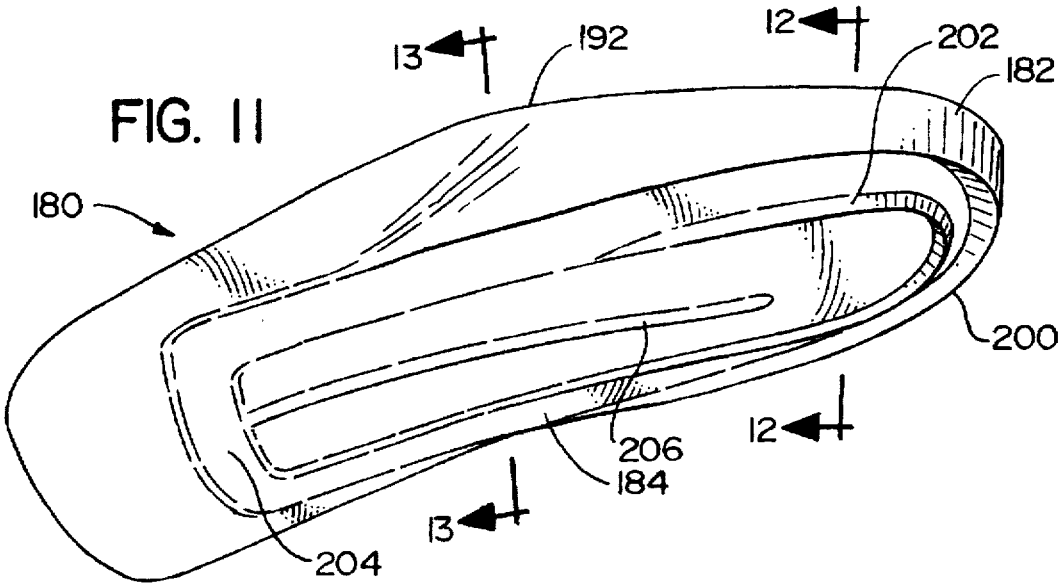
FIG. 11 is an isometric view of the orthotic of FIG. 10, with the view being taken from a location looking from the side and upwardly toward the bottom surface of the blank.
Figure 12:
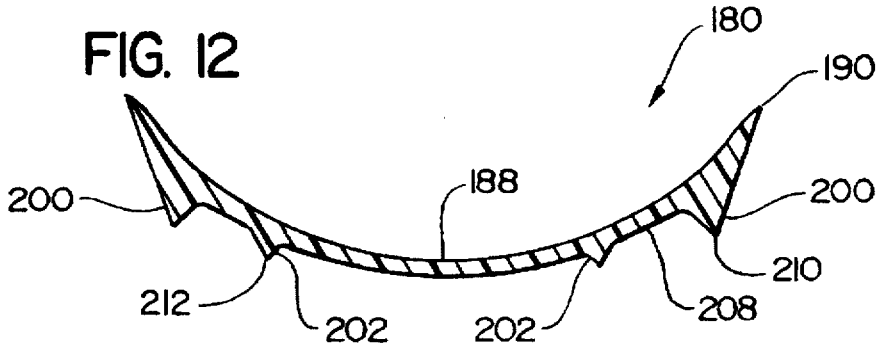
FIG. 12 is an end view of a section of the orthotic of FIG. 11, taken along line 12—12.

Outer, or peripheral, ridge 112 on either side of heel cup 120 extends a significant distance below the lower surface of orthotic insert 100, and has a relatively sharp lower edge 124. For example, peripheral edge 112 may extend about 5/16 inch below upper edges 129 of heel cup 120. The sharp lower edges of the ridges penetrate into the upper surface of the insole under the weight of the user's foot to prevent longitudinal movement of heel section 106. The peripheral ridge is proportionately lower on the lateral (i.e., outward) side 126, as compared to the medial (i.e., inward) side 128 around heel cup 120. FIGS. 10–12 also shows inner ridge 202, which is relatively shallow in the area of heel cup 188, and, consequently, does not extend as far below the lower surface of the orthotic insert as does outer or peripheral ridge 200. This arrangement stabilizes heel section 182 against side-to-side rocking.

Figure 4:
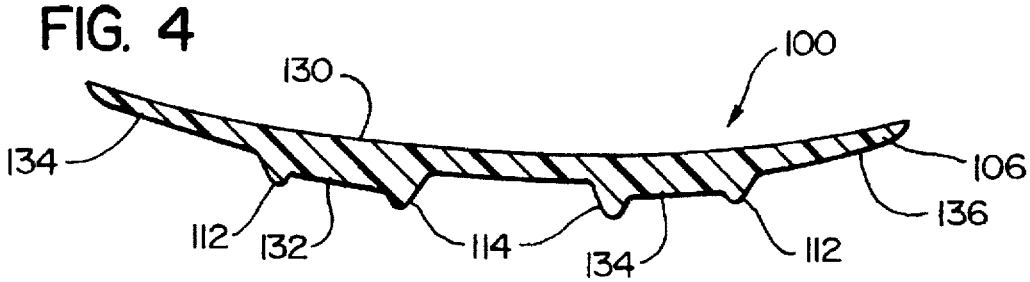
FIG. 4 is an end view of a section of the orthotic of FIG. 2, taken along line 4—4.

FIG. 4 shows an end view of a section taken through orthotic insert 100 and a curved arch section 106. The upper surface 130 of orthotic insert 100 in this area is also slightly concave, so as to cradle the wearer's foot, but is less concave than heel cup 120 described above. In this section, also, inner ridge 114 is more pronounced, extending downwardly from the lower side of orthotic insert 100 by a slightly greater distance than does outer or peripheral ridge 112. The material of orthotic insert 100 is also preferably thickened in regions 132 and 134 between ridges 112 and 114 in this section. This arrangement provides a number of advantages, including increased strength, resilience, and durability when arch section 106 or orthotic insert 100 is flexed, as will be discussed below. It should also be noted that, in this section, the medial edge 134 of orthotic insert 100 extends inwardly and upwardly a greater distance than does lateral edge 136; this arrangement provides greater support for the wearer's arch near the medial edge of the insert.

Figure 5:
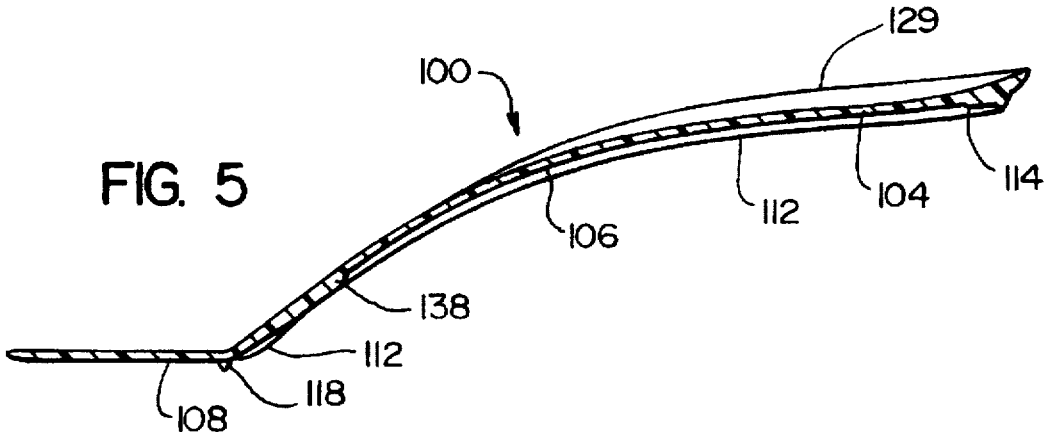
FIG. 5 is a side view of a section of the orthotic of FIG. 2 taken along line 5—5.

FIG. 5 shows a side view of a longitudinal section through orthotic 100 taken along line 5—5 shown in FIG. 2. As noted above, heel section 104 and forefoot section 108 are generally planar, and are interconnected by arch section 106, which is strongly curved. The curvature of arch section 106, at its greatest, may be on the order of 35 degrees to the planar sections 104 and 108. Preferably, for reasons which will be described below, the curvature of arch section 106 (at the lower surface of orthotic insert 100) exceeds the external curvature of the upper surface of the insole of the typical style shoe in which orthotic insert 100 is applied.

Figure 9:
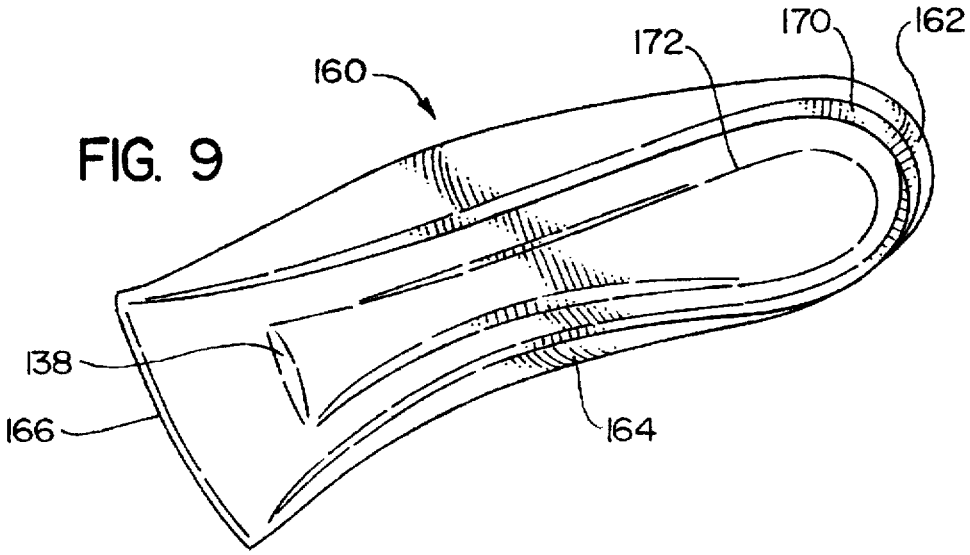
FIG. 9 is an isometric view of the orthotic of FIG. 8, with the view being taken from the location looking from the side and upwardly toward the bottom surface of the orthotic.

With further reference to FIG. 5, it will be seen that inner ridge 114 terminates near the forward, lower (distal) end of arch section 106, and that the material of orthotic insert 100 thickens near the centerline of the insert in this area, as indicated by reference numeral 138 (see also FIGS. 9 and 2).

The upper surface of orthotic insert 100 may preferably be covered with a soft top cover (not shown), formed, for example, of vinyl, cloth, soft leather, or the like, so as to increase the comfort of the wearer.

Figure 6:
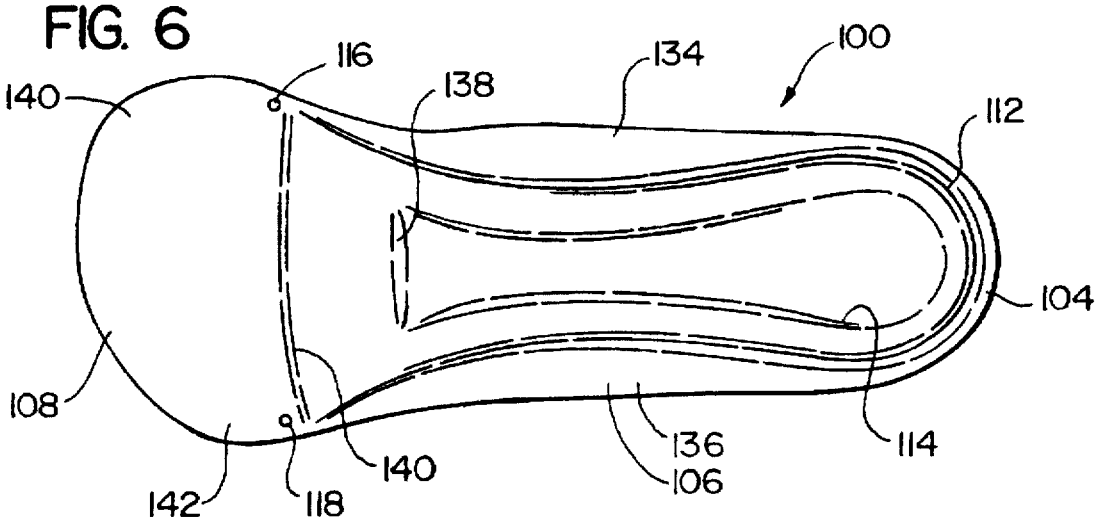
FIG. 6 is a bottom plan view of the orthotic of FIG. 2.

Attention is next directed to FIG. 6, which shows the underside of orthotic insert 100, in a plan view. FIG. 6 clearly shows the U-shaped pattern of outer and inner ridges 112 and 114, as they extend down the sides of orthotic insert 100, on both sides of the longitudinal axis of orthotic insert 100, and completely about the heel section 104. FIG. 6 also shows junction 140, where curved arch section 106 meets and is joined with planar forefoot section 108. Junction 140 is curved, convexly toward forefoot section 108, so as to conform generally with the arrangement of the metatarsal heads, when the wearer's foot is in the shoe in which orthotic insert 100 is installed, so as to comfortably support the wearer's foot in this contact area. A straight line connecting the two points where junction 140 meets the edges of orthotic insert 100 would cross a longitudinal centerline of orthotic insert 100 at an angle of approximately 5 degrees, with the point at the medial edge (which would be proximate the large toe of the wearer) located slightly more forward than the point at the lateral edge. It should be noted, however, that the forwardmost area of the rigid orthotic insert 100 in forefoot section 108 has the outside (small toe) area extending somewhat more forward so as to provide lateral support across the entire area of the foot from the first metatarsal joint all the way to the fifth metatarsal joint.

Forefoot section 108 of orthotic insert 100 supports the metatarsal heads and the toes of the wearer and the distal, downwardly plantar flexed position. Forefoot section 108 has a medial portion 140 (which supports the wearer's large toe), and a lateral portion 142.

As noted above, when the foot is placed within the confines of a style shoe, it is immobilized in an abnormal position. Stability of the foot is obtained by positioning the joints, and not by motion within the joint. In order to obtain stability or foot plantar-flexed within a style shoe, by optimizing, supporting, and maintaining the positions of the joints of the foot, orthotic insert 100 is fabricated in such a way that:

1. The calcaneus (heel bone is supported in its inverted position (i.e., with its bottom end tilted inwardly), since the plantar flexion of the ankle by the style shoe inverts the rear foot;
2. The contours of the midfoot of the device (i.e., the curved arch section 106) support the increased inclination of the calcaneus to the peak of the arch, and then support the declination of the metatarsals distally; and
3. The forefoot is everted (i.e., turned aside, or outwardly) against the immobilized (stabilized) rear foot; i.e., the lateral (outside) portion of the forefoot is rotated against the rear foot so as to force the medial (inside or arch side) of the forefoot into the floor. This locks the mid-tarsal joint without benefit of subtalar joint motion.

With reference to the structure of orthotic insert 100, design parameters which assist in obtaining the desired stability of the foot within a style shoe include:

1. A concave heel seat 120, as previously mentioned, whose center point 122 faces laterally by 4 degrees (this means that the heel seat is actually 4 degrees inverted, solely on the basis of the weight-bearing point of the heel). The heel seat consequently supports the calcaneus in the inverted position which is caused by plantar flexion of the ankle by the style shoe;

2. The concavity of the heel is suspended by its peripheral support (i.e., peripheral ridge 112); in other words, the weight-bearing point of the heel does not contact the floor (through the heel of the shoe) unless weight is borne. Thus, the suspended design absorbs shock at heel contact, when the stress of body weight forces the heel cup plantarly, and the heel cup deforms plantarly;
3. The peripheral ridge around the heel cup has two primary functions:
   a. It serves as a focal point through which force passes from the foot device into the shoe. This focal point causes the sharp lower edge 124 of the peripheral ridge 112 to bite into the upper surface of the insole of the shoe, making a stabilizing groove to hold the orthotic insert 100 in proper alignment;
   b. It positions the heel cup of the foot device 4 degrees inverted, because the peripheral ridge 114 is proportionally lower on the lateral (outward) side as compared to the medial (inward) side;
4. The distal lateral (i.e., lower outward) edge of the orthotic insert 100 is fabricated longer to the center of the fifth metatarsal head (i.e., the base of the small toe) in order to support and stabilize the fifth metatarsal in its plantar-flexed position; and
5. From the midfoot forward, orthotic insert 100 is thicker laterally (outwardly) than medially (inwardly), with more reinforcement provided plantarly. This creates a wedge which everts the forefoot onto the rear foot so as to lock the metatarsal joint by positioning only.

Figure 7:
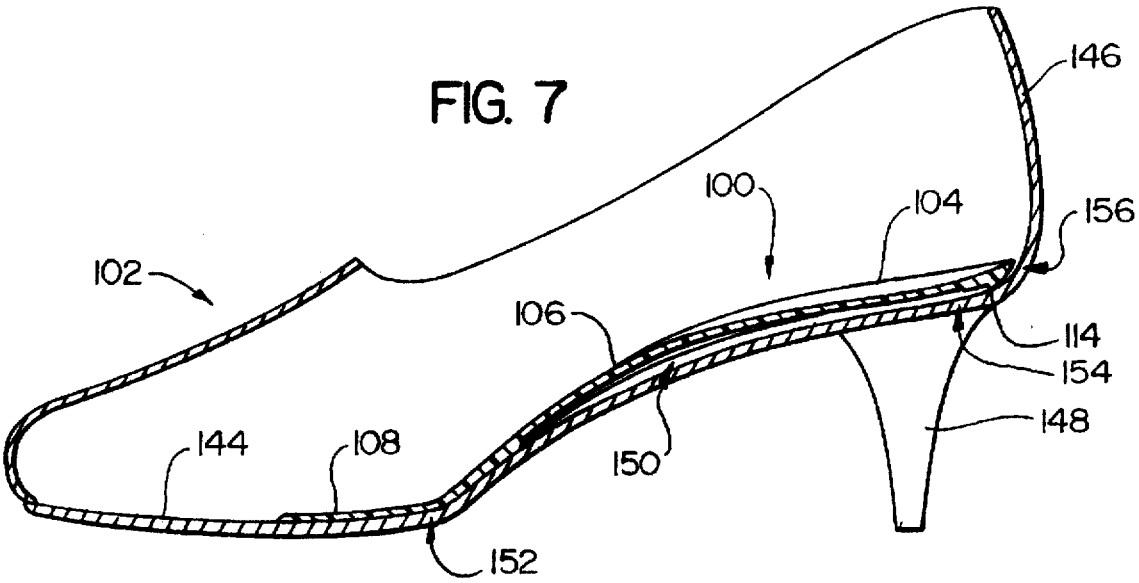
FIG. 7 is a side view of a longitudinal section of a style shoe having the orthotic of FIG. 2 applied therein according to the present invention.

Attention is now directed to FIG. 7, which shows a side view of a longitudinal section taken through orthotic insert 100 installed in style shoe 102. Style shoe 102 has a greatly curved insole 144, to which is attached a shoe upper 146 and a high heel 148. Accordingly, it is apparent that the foot of a wearer of style shoe 102 will be plantar flexed in the typical manner heretofore described.

Orthotic insert 100 is installed in style shoe 102 so that its heel, arch, and forefoot sections fit into the corresponding sections of the shoe. It is apparent that the depth dimension of orthotic insert 100 relative to the interior of style shoe 102 is relatively low, primarily for cosmetic reasons. As was noted above, arch section 106 of orthotic 100 typically has a curvature greater than that of the arch portion of insole 144, providing additional arch support for the user; accordingly, a gap 150 is formed intermediate the underside of orthotic insert 100 and the upper surface of insole 144. Gap 15 extends from beneath arch section 106 to beneath heel section 104; heel section 104 is suspended above the heel portion of insole 144 by peripheral ridge 114, in the manner previously described. Gap 150 provides shock absorption and consequent cushioning for the foot of a wearer; curved arch section 106 is supported above the upper surface of insole 144 under light loads by the additional rigidity or strengthening provided by thickened portions 130 and 132 between ridges 112 and 114 (see FIG. 4), but will flex downwardly when weight or shock is applied to the upper surface of heel section 104 and arch section 106 of orthotic insert 100, in the course of the wearer's gait cycle. In other words, at heel strike, the suspended heel seat will flex toward the shoe, absorbing some of the energy of heel contact. In this manner, the orthotic insert of the present invention has a built-in shock absorbing mechanism. In addition, this collapsing of the center of the suspended heel will cause the periphery of the device to flex toward the center, grasping the rear portion of the foot. In essence, the flexion of the suspended heel portion of the foot plate causes a stabilizing effect on the rear foot, because the medial, posterior, and lateral segments of the rear portion of the foot plate move toward (or into) the foot to provide additional stability by "containment".

Orthotic insert 100 is maintained in position against sliding downwardly or "downhill" along insole 144 by (a) spikes 116 and 118 (not shown in FIG. 7), which penetrate into and engage insole 144 in the region indicated generally by reference numeral 152, in the forefoot portion of the shoe, and (b) the sharp lower edge 124 of peripheral ridge 114, which digs into and engages insole 144 in the region indicated generally be reference numeral 154, in the heel portion of the shoe. In this position, the rear end of orthotic insert 100 is forced against the inner surface of the rear portion of shoe upper 146, in the region indicated generally by reference numeral 156, so as to help maintain gap 150 by keeping curved arch section 106 bowed above the arch portion of insole 144. Thus, it is apparent that curved arch section 106 forms a flexed or flexible portion between the fixed portions represented by forefoot section 108 and heel section 104; the device of the present invention is consequently able to provide the beneficial and desirable flexibility for the arch of the user's foot, while the rear 25% of the foot is kept relatively fixed and stable, as is important in attaining the desired stability for the foot when in a style shoe.

Figure 8:
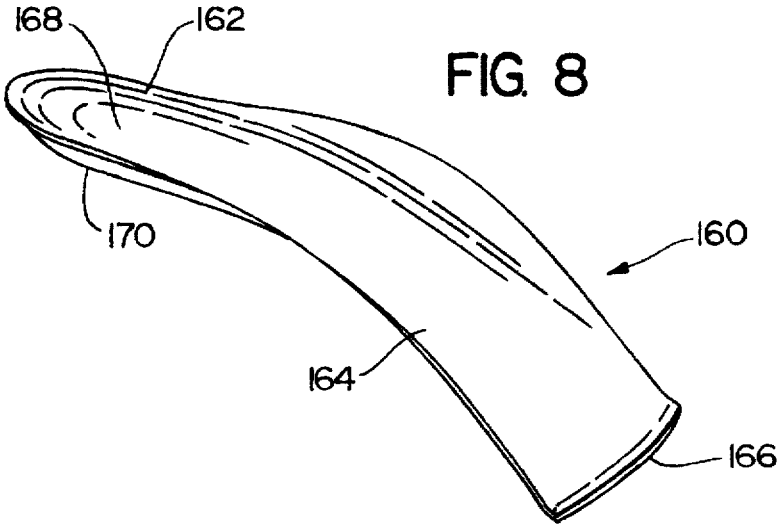
FIG. 8 is an isometric view of an orthotic according to a second preferred embodiment of the present invention, with the view being taken from a location looking from the side and downwardly toward the top surface of the orthotic.

FIGS. 1 through 7 have illustrated an orthotic insert 100 having a forefoot section 108. In some applications, however, it may be desirable to provide an orthotic insert for style shoes which does not have a forefoot section. FIG. 8 shows an orthotic insert 160, which is substantially identical to orthotic insert 100 described above, with the exception that the forefoot section has been eliminated. Accordingly, orthotic insert 160 includes a semiplanar heel section 162 and a curved arch section 164 which extends downwardly therefrom. Arch section 164 terminates at a forward edge 166, which is curved convexly in the forefoot direction, in the manner of junction 140 described above. With orthotic insert 160 installed in typical style shoe 102 (see FIG. 7) forward edge 166 consequently abuts insole 144 in the region indicated generally by reference numeral 152, and provides a smooth and comfortable transition area from insole 144 to the upper surface of orthotic insert 160 for the user's foot.

The features of heel section 162 and arch section 164 are substantially identical to those of the corresponding sections of orthotic insert 100, as were described above. For example, heel section 162 is provided with a concave upper surface which forms a heel cup 168, and a peripheral U-shaped ridge 170 about its lower surface.

FIG. 9 shows the lower surface of orthotic insert 160, which is provided with U-shaped outer, peripheral ridge 170 and U-shaped inner ridge 172. As with outer and inner ridges 112 and 114 which were described above with respect to orthotic insert 100, outer and inner ridges 170 and 172 of orthotic insert 160 are parallel to one another, and extend curvilinearly along both the medial and lateral sides of orthotic insert 160, and completely about the end of heel section 162. In short, apart from the absence of a forefoot section, orthotic insert 160 shown in FIGS. 15 and 16 is substantially identical to orthotic insert 100 shown in FIGS. 2 through 7.

As noted above, the orthotic insert, 100 or 106, may have a soft cover attached to its upper surface to increase the wearer's comfort. In the case of orthotic insert 160 shown in FIGS. 8 and 9, the soft cover may be attached to the upper surface of orthotic insert 160, and may extend distally or forwardly beyond forward edge 166, into the forefoot portion of the style shoe, where it would rest on the forefoot portion of insole 144 (see FIG. 7). A soft top cover, which, as mentioned above, may be formed of any suitable material, such as vinyl, cloth, and the like, may be a full-length soft top cover attached to the upper surface of either the long or short embodiments of orthotic insert described above, or maybe a short length soft top cover attached to the upper surface of the shorter orthotic insert 160. The soft top cover may be formed separately from the semi-rigid orthotic insert, and then attached thereto, as by means of adhesives; alternatively, a particularly cost-effective and durable insert may be formed by first forming the semi-rigid orthotic insert base, as by injection molding using a first suitable material in a first mold, and then placing the formed orthotic insert base in a second mold and injection molding the soft top cover directly onto the upper surface of the semi-rigid base, using a second, suitably soft material.

Attention is now directed to FIG. 10, which shows an orthotic insert 180. Orthotic insert 180 is a semi-rigid or rigid insert, which differs from the previously described orthotic inserts 100 and 160 in that orthotic insert 180 is intended for use in a normal shoe application (i.e., a non-style shoe application). Since the foot of a wearer of a normal shoe is typically not immobilized in an abnormal, plantar flexed position which would impair or stop the normal motions within the joints of the foot (as is the case with the style shoe), stability is obtained in the normal manner, by normal motion of the joint, and not by the positioning of the joints, as is required with the style shoe. Accordingly, orthotic insert 180 is adapted to support the foot of a wearer throughout its normal motions in the course of the wearer's gait cycle. Furthermore, since the interior of a normal shoe is typically much less confining than that of a style shoe, orthotic insert 180 can extend for greater distances, both laterally and upwardly, than the style shoe orthotics.

FIG. 10 shows an orthotic insert 180 which is adapted for use with a person's right foot. Orthotic insert 180 includes generally a heel section 182, and a gently curved arch section 184, which tapers off toward the forefoot area, and terminates in a forward edge 186 which is positioned approximately just behind and below the metatarsal heads of the foot of the user. Heel section 182 has a relatively deeply concave upper surface which forms a heel cup 188. As mentioned above, the additional space in a normal shoe allows orthotic insert 180 to extend upwardly a greater distance than the orthotic inserts for a style shoe; consequently, the upper edge 190 of heel section 182 extends on the order of ½ inch above the center of heel cup 188, providing a much deeper heel cup to receive the user's heel. Edges around the heel cups of the style shoe orthotic inserts, by contrast, may extend about 3/16 inch above the center of the heel cup.

Arch section 184 curves downwardly from the general plane of heel section 182, preferably at an angle of about 10 degrees. Medial edge 192 extends inwardly from the centerline of insert 180 (by a greater distance than lateral edge 194 extends outwardly), and upwardly to provide additional arch support.

The medial forward corner of orthotic insert 180 extends slightly further in the forefoot direction than does the lateral forward corner; leading edge 186 consequently crosses the centerline of insert 180 at an angle which is approximately 7 or 8 degrees offset from perpendicular.

FIG. 11 shows the lower surface of orthotic insert 180, from which U-shaped outer ridge 200 and U-shaped inner ridge 202 protrude downwardly. As with the U-shaped ridges previously described with reference to FIGS. 2 through 9, outer and inner ridges 200 and 202 are parallel, curvilinear ridges which extend around the heel of the insert and down both sides thereof. In this case, both ridges terminate in a thickened section 204 under the forward end of arch section 184, preferably about 1 inch rearward of forward edge 186. A central strengthening rib 206 is formed along the underside of arch section 184, to provide additional strength and resilience to the arch section, but preferably does not extend back under the heel cup of heel section 182. With an orthotic insert 180 having an overall length of about 6¾ inches, a central strengthening rib 206 beginning approximately 1½ inches from forward edge 186 and extending for about 3½ inches has been found to be particularly suitable.

FIG. 12 shows an end view of a section of orthotic 180 taken along 12—12 through heel section 182. It is apparent from FIG. 12 that, as was mentioned above, heel cup 188 is deeply concave, and edges 190 extend upwardly a significant distance around heel cup 188. Outer and inner U-shaped ridges 200 and 202 protrude downwardly from the lower surface 208 of orthotic insert 180. Outer, peripheral ridge 200 has a sharp, pointed, lower edge 210, and inner U-shaped ridge 202 has a corresponding sharp lower edge 212. As with the previously described ridges, the sharp lower edges 210 and 212 of U-shaped ridges 200 and 202 serve to dig into the insole of the shoe in which insert 180 is installed, forming a groove and helping to maintain the insert in position. This case, however, lower edge 212 of inner rib 202 actually extends down further than does lower edge 210 of peripheral ridge 200. This arrangement permits a limited amount of side-to-side rocking motion, which is desirable for an orthotic insert which is used in a normal shoe; the reason for this is that the foot goes through something of a rocking motion where the heel goes from side-to-side, in the course of the normal gait cycle. The relative distances which the lower edges of the ridges extend beneath lower surface 208 of orthotic insert 180 control both the degree of the heel rocking, and also the angular position of the heel as the foot rocks from one side to the other. In the example illustrated in FIG. 12, lower edge 210 of peripheral ridge 200 extends downwardly about ½ inch from upper edge 190, at an angle of about 70 degrees to horizontal, and lower edge 212 of inner ridge 202 extends about 3/32 inch further downwardly than does lower edge 210 of ridge 200; inner and outer ridges 202 and 200 are separated from each other by lateral distance of about ⅛ inch.

Figure 13:
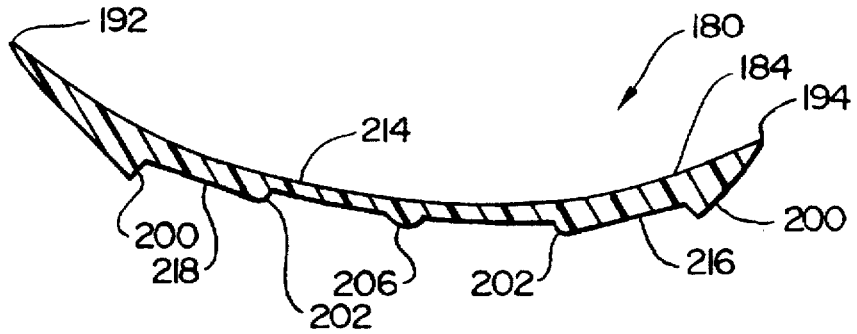
FIG. 13 is an end view of a section of the orthotic of FIG. 11, taken along line 13—13.

FIG. 13 shows an end view of a section through arch section 184 of orthotic insert 180, along line 13—13 shown in FIG. 11.

Upper surface 214 of orthotic insert 180 remains concavely curved in arch section 184, so as to cradle and support the user's foot. As was noted above, medial edge 192 extends laterally and upwardly further than does lateral edge 194, so as to provide additional arch support. Outer and inner ridges 200 and 202 are somewhat shallower under arch section 184, and in this section thickened regions 216 and 218 are formed so as provide additional resilience and strength. As was also noted above, longitudinal strengthening rib 206 extends along the underside of arch section 184, providing additional resilience and strength.

Figure 14:
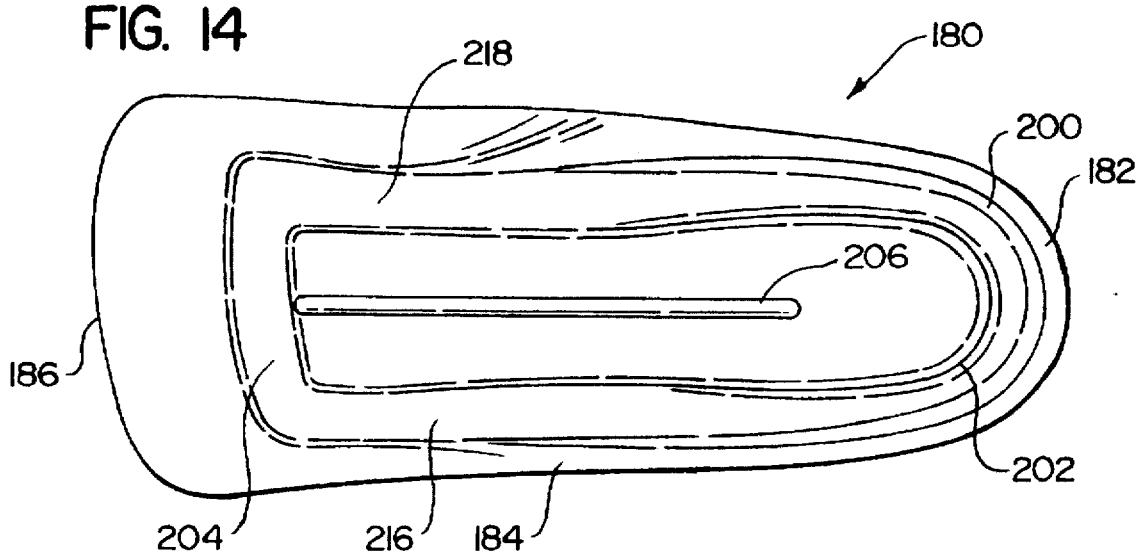
FIG. 14 is a bottom plan view of the orthotic of FIGS. 10–11.

FIG. 14 shows the underside or orthotic insert 180, a plan view, so that the arrangement of the previously described features thereon is more readily apparent.

Having described the structure of orthotic inserts according to the present invention which are inexpensive to manufacture yet effective, and which are thus suitable for purchase and use by the general populace, the adjustment of the orthotics to meet the requirements of individual users will now be described. As noted above, the purposes of the U-shaped ridges on the undersides of the orthotics include both maintaining the orthotic insert in position in the shoe, and aligning the angle that the calcaneus (heel bone) functions relative to the floor. The positioning and downwardly extending lengths of the ridges are such that when the ridges are fully weight-bearing in function, the calcaneus is inverted (tilted inward) to the floor by a predetermined number of degrees, such as 4 degrees. This angulation of the heel to the floor may be altered by incrementally removing or eliminating the distal, lower edge of the appropriate ridge or ridges at appropriate points. For example, to invert (tilt inward) the rear foot by an increased angle, the ridge or ridges would be shortened in the appropriate area on the lateral (outside) side of the heel portion of the insert. Similarly, to evert the rear foot by an increased angle, the medial (inside) portions of the ridge or ridges will be shortened. In this fashion, changes in the position of the calcaneus (heel bone) can be easily effected. Thus, the device could be tilted inwardly (inverted) or outwardly (everted), depending on the position of the calcaneus when the subtalar joint is neutral during stance or gait. The ridges could also be modified for a more imperical reason: if a given foot cannot tolerate the orthotic insert because the positioning of the foot is subjectively inappropriate to the wearer, or produces a pressure area to the wearer (for example, from an underlying ridge sitting on an irregular heel cup within a shoe insole) then the ridges can be appropriately filed down or ground down to accommodate the requirements of the wearer. Furthermore, as noted above, the inner U-shaped ridge of the orthotic insert 180 for use in normal shoes in part serves the function of permitting side-to-side rocking of the insert, possibly by about a 4 degree angle; the inner U-shaped ridge thus can also be incrementally reduced so that the wearer can control the amount of movement in the rocking motion of the heel.

It is very easy for an individual, relatively unskilled wearer to effect these adjustments to the orthotic insert of the present invention. The wearer can simply shave the appropriate areas of the ridges with a knife or razor, or grind them down with a file, or the like, so as to achieve the desired reduction in the height in the ridge. The relatively rigid material of the orthotic insert which forms the ridges renders this process very simple to perform and control, and the sharp, pointed lower edges of the ridges make it even easier to selectively and incrementally remove the material. Thus, individual purchasers of the orthotic inserts in accordance with the present invention can readily make these adjustments on their own.

While the orthotic inserts according to the present invention are consequently highly suitable to be sold and used by the general public as is, without professional assistance, professional personnel, such as podiatrists, may also wish to use the orthotic inserts according to the present invention, and may desire to enhance the performance thereof by vacuum-forming the inserts to the user's feet, in generally the same manner as is described in U.S. Pat. No. 4,718,179 (Brown '179), the entirety of which is hereby incorporated by reference.

Attention is thus next directed to FIGS. 15 through 19, which show a sequence of steps in fitting an orthotic insert to a person's foot, using a vacuum forming technique. FIG. 15 shows an orthotic insert 220, which is initially placed against the person's foot 222 to check for size. In the example illustrated in FIG. 15, the orthotic insert 220 is of the normal shoe type, as was described with reference to FIGS. 10 through 14; consequently, the forward edge of orthotic insert 220 should reach just behind the metatarsal heads of the person's foot.

Orthotic insert 220 is formed of a material which is relatively rigid or semirigid, and is formed from a thermal plastic material, such as, for example, polyethylene, polypropylene (with or without dilutants such as talc), epoxy and fiberglass, or other materials. The preferred material of orthotic insert 220 is characterized in that it can be permanently deformed at a moderately elevated temperature (i.e., 150° to 300° Fahrenheit), and upon hardening at normal temperatures, it has a predetermined and programmable resistance to deformation in a manner that, when distorted, the material will return to its original configuration.

As illustrated in FIG. 16, orthotic insert 220 is next placed on a spatula 224 and place in an oven 226. In FIG. 16, the heel portion of orthotic 220 is shown as being placed in the furtherest rearward part of the oven. However, if the heating of the oven is not uniform, it may be desirable to place the forward portion of the insert into the oven first to ensure that the midfoot and forefoot portions are adequately heated. In any event, the heating step in FIG. 16 is accomplished so that desirably the entire orthotic 220 is heated to a moderately elevated temperature (150° to 300° Fahrenheit) so that the material forming the insert is sufficiently yielding so that it can be deformed and contoured to a person's foot 222 so as to take a permanent set matching the desired contour for the plantar surface of the person's foot.

Next, there is the utilization of the vacuum forming technique to properly form the orthotic insert 220 to the bottom of the foot 222. As illustrated in FIG. 17, there is a suction tube 228 that is applied to the person's ankle by means of a fitting 230 and an elastic band 232. The intake end 234 of the tube 228 is on the upper surface of the person's midfoot. An elastic band 236 is slipped around the person's foot 222 to hold the orthotic insert 220 in place against the bottom of the foot.

Figure 19:
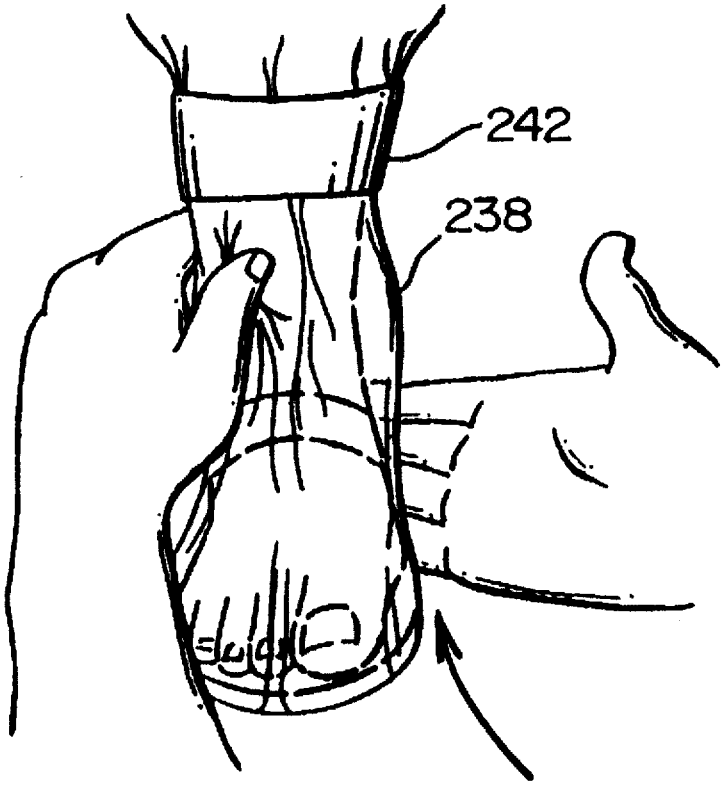

As illustrated in FIG. 18, the next step is to place a flexible transparent plastic bag 238 around the foot and upwardly around the ankle 240. As shown in FIG. 19, the upper part of the bag which is around the ankle is pressed against the ankle by means of a peripheral band 242. The orthotic insert 220 is then pressed gently against the heel of a person's foot. A vacuum pumped is turned on to suck air through inlet tube 228 to cause bag 238 to press the orthotic insert against the bottom of the person's foot with the appropriate pressure.

Then, the operator positions the foot in the desired position, and specifically positions the forward part of the foot appropriately relative to the rear portion of the person's foot. This may be done in a manner so that the foot is in the neutral position, with the forward part of the foot in position so that the midtarsal joint is in its locked or nearly locked position.

It is to be understood that the orthotic insert 220, when heated, is sufficiently yielding so that the force of the atmospheric pressure (resulting from the application of the vacuum within the bag 238) is sufficient to shape the orthotic insert 220 so that it will properly conform to the lower surface of the person's foot. Thus, with the operator properly positioning the person's foot, the orthotic insert 220 assumes a shape closely corresponding to the plantar surface of the person's foot, or the foot is in the optimized position, as discussed above.

Within a short period of time, the orthotic insert 220 will cool to a room temperature so that the insert will harden into the proper configuration which it had assumed during the vacuum forming step described above.

An orthotic insert for the other foot is fitted in substantially the same manner as described above. It becomes apparent from the above description that one of the significant advantages of the present invention using the vacuum forming technique is that a finished pair of orthotics, custom contoured to accommodate the individual characteristics of the person's foot, can be produced relatively quickly and easily by a professional.

It is to be understood that various modifications could be made to the present invention without departing from the basic teachings thereof.

What is claimed and described to be secured by Letters Patent of the United States is:

1. An orthotic insert having a forward to rear lengthwise axis and adapted to be placed within a shoe, said orthotic insert comprising:

a substantially rigid base member having a rearwardly located heel portion forming a concave heel seat, and a longitudinally extending curved arch portion, said base member having upper and lower surfaces, said upper surface being generally contoured to fit a plantar surface of a person's foot; and at least one U-shaped ridge formed on said lower surface of said base member and extending continuously around a rearward end of said heel portion and forwardly along both medial and lateral sides of said base member;

said rigid ridge projecting downwardly from said lower surface of said base member a sufficient distance to support said heel seat above an upper surface of an insole a shoe;

said ridge being formed of substantially rigid material so as to be able to support the weight of a person's foot without collapsing, said ridge also having a sharp, vertically-pointed lower edge which is defined by steep, downwardly-angled inner and outer wall portions for penetrating into an insole in response to the weight of a person's foot being applied to said upper surface of said base member, so that said ridge maintains said insert in a longitudinally fixed position and supports said base member so as to position the person's foot in a desired angular orientation;

said lower edge of said ridge being configured to permit said angular orientation to be incrementally adjusted in medial, lateral, and rearward directions by incremental removal of material from corresponding portions of said lower edge of said ridge which extends around said rearward end of said heel portion and along said medial and lateral sides of said base member.

2. The orthotic insert of claim 1, wherein said at least one ridge comprises outer and inner substantially parallel, spaced apart ridges, one said parallel ridge projecting downwardly a greater distance below said lower surface of said heel portion of said base member than the other said parallel ridge.

3. The orthotic insert of claim 2, wherein said outer ridge projects downwardly from said lower surface of said heel portion of said base member by a greater distance than does said inner ridge, so as to stabilize said heel portion of said base member against side-to-side rocking when said orthotic insert is placed within a style shoe having an insole with a relatively steeply downcurved arch portion such that a person's foot is kept immobilized in a plantar flexed configuration as said person walks.

4. The orthotic insert of claim 3, wherein said base member further comprises a forwardly located forefoot portion having upper surface and lower surfaces.

5. The orthotic insert of claim 4 comprising at least one spike formed on said lower surface of said forefoot portion of said base member, said spike having a sharply pointed lower end for penetrating into an upper surface of an insole so as to maintain said forefoot portion of said orthotic insert in a longitudinally fixed position in a shoe when weight is applied to an upper surface of said base member by a person's foot.

6. The orthotic insert of claim 5, wherein said at least one spike comprises first and second spikes located proximate a rearward end of said forefoot portion of said base member.

7. The orthotic insert of claim 6, wherein said curved arch portion of said base member has a curvature which exceeds that of a curved arch portion of such an insole, so that a gap is formed intermediate said lower surface of said base member and an upper surface of such a curved arch portion of such an insole when said insert is placed in such a style shoe.

8. The orthotic insert of claim 7, further comprising thickened portions of said base member intermediate said parallel ridges in said arch portion of said base member, for providing said arch portion of said base member with relatively greater strength and resilience to flexing.

9. The orthotic insert of claim 2, wherein said inner ridge projects downwardly from said lower surface of said heel portion of said base member by a greater distance than does said outer ridge, so as to permit a controlled amount of side-to-side rocking of said heel portion of said base member when said orthotic insert is placed within a normal shoe having an insole with a relatively gently downcurved arch portion such that a person's foot is permitted to transition from a mobile adaptor to a rigid lever as said person walks.

10. The orthotic insert of claim 1, wherein said base member is formed of injection molded plastic.

11. The orthotic insert of claim 1, further comprising a relatively resilient top cover mounted to said upper surface of said base member for enhancing the comfort of a person's foot.

12. A method for supporting a person's foot in a desired angular orientation in a shoe, said method comprising the sequential steps of:

placing an orthotic insert in a shoe, said insert comprising:

a substantially rigid base member having a rearwardly located heel portion forming a concave heel seat, and a longitudinally extending curved arch portion, said base member having a lower surface and an upper surface, said upper surface being generally contoured to fit a plantar surface of a person's foot; and at least one U-shaped ridge formed on said lower surface of said base member and extending continuously around a rearward end of said heel portion and forwardly along both medial and lateral sides of said base member;

said rigid ridge projecting downwardly from said lower surface of said base member a sufficient distance to support said heel seat above an upper surface of an insole a shoe;

said ridge being formed of substantially rigid material so as to be able to support the weight of a person's foot without collapsing, said ridge also having a sharp, vertically-pointed lower edge which is defined by steep, downwardly angled inner and outer wall portions for penetrating into an insole in response to the weight of a person's foot being applied to said upper surface of said base member, so that said ridge maintains said insert in a longitudinally fixed position and supports said base member so as to position the person's foot in a desired angular orientation;

said lower edge of said ridge being configured to permit said angular orientation to be incrementally adjusted in medial, lateral, and rearward directions by incremental removal of material from corresponding portions of said lower edge of said ridge which extends around said rearward end of said heel position and along said medial and lateral sides of said base member;

placing a person's foot in said shoe so as to determine a first angular orientation in which said foot is supported by said insert in response to said ridge bearing the weight of said foot;

removing said insert from said shoe;

removing material by increments from said lower edge of said U-shaped ridge at a selected medial, lateral, or rearward location thereon so as to decrease the distance by which said ridge extends downwardly from said lower surface of said base member at said selected location;

replacing said insert in said shoe; and replacing said person's foot in said shoe so that in response to said orthotic insert bearing said weight of said foot, said sharply-pointed lower edge of said ridge penetrates into said insole of said shoe so as to prevent said insert from slipping relative to said insole and said selected location on said ridge from which material has been removed supports said heel portion at a reduced distance above said insole so as to adjust said foot from said first angular orientation to said desired angular orientation.

13. A unitary orthotic insert for a shoe, said insert comprising:

a substantially rigid base member having a rearwardly located heel portion forming a concave heel seat, and a longitudinally-extending curved arch portion;

a first U-shaped, rigid ridge formed on a lower surface of said base member and extending around a heel end of said insert;

a second U-shaped, rigid ridge formed on said lower surface of said base member, said second ridge being spaced inwardly from said first ridge and extending generally parallel thereto around said heel end of said insert;

a selected one of said ridges extending downwardly from said lower surface of said insert by a greater distance than the other said ridge towards said heel end of said insert and having a sharply pointed lower edge for penetrating into and engages an insole in response to said selected ridge bearing the weight of said foot, so as to both prevent said insert from slipping relative to such an insole and support said lower surface of said insert beneath said heel seat a spaced distance above such an insole so that said heel portion is positioned in an angular orientation, said ridge having sufficient rigidity to support said heel portion under said person's foot without undergoing significant collapse;

said lower edge of said selected one of said rigid ridges extending substantially continuously around said heel end of said insert and generally longitudinally along said arch portion on both medial and lateral sides thereof so that said angular orientation in which said heel portion of said insert is positioned when said weight is supported by said ridge is selectively adjustable in generally medial, lateral, and rearward directions by removal of material from corresponding portions of said selected ridge;

said heel portion of said insert being substantially free of other projections extending downwardly sufficiently far from said lower surface that such other projections could abut an insole so as to prevent selective adjustment of said angular orientation by removal of material from said selected ridge alone.

14. The orthotic insert of claim 13, wherein said base member is configured to be removably placed in a style shoe having a relatively steeply downcurved arch portion so that said person's foot is plantar flexed in such a shoe, and said selected U-shaped ridge which extends downwardly from said lower surface by a greater distance than said other ridge is said outer ridge, so that said outer U-shaped ridge engages an insole of such a style shoe so that said heel portion of said insert is stabilized against side-to-side rocking in such a shoe.

15. The orthotic insert of claim 14, wherein said curved arch portion of said base member has a curvature which exceeds that of a steeply downcurved arch portion of such a style shoe, so that a vertically spaced gap is formed intermediate an insole of such a shoe and said first and second ridges and lower surface of said insert in said curved arch portion of said insert when said insert is placed in such a shoe, said gap being configured to permit said arch portion of said insert to flex in a vertical direction relative to such an insole under said foot as said person walks.

16. The orthotic insert of claim 15, further comprising relatively thickened portions of said base member formed intermediate said outer and inner ridges in said arch portion of said insert for providing said arch portion with relatively greater strength and resilience to flexing under said person's foot.

17. The orthotic insert of claim 16, wherein said base member is configured to be placed in a style shoe having a forefoot portion insole which extends in a substantially horizontal direction from such a downcurved arch portion, and said orthotic insert further comprises:

a forefoot portion of said base member which extends substantially horizontally from a junction between said arch and forefoot portions of said base member, said junction extending transversely across said base member from said medial side to said lateral side thereof, said forefoot portion of said base member being configured to rest on top of such a horizontally extending forefoot portion insole of such a shoe, and having at least one downwardly extending protrusion for engaging such a forefoot portion insole in response to pressure applied to an upper surface of said base member by said person's foot, so as to prevent slipping movement of said forefoot portion of said base member relative to such a forefoot portion insole as said person walks.

18. The orthotic insert of claim 17, wherein said at least one downwardly extending protrusion comprises a first spike positioned proximate a point where said junction between said arch and forefoot portions of said base member meets said medial side thereof, and a second said spike positioned proximate a point where said junction meets said lateral side of said base member, so that said first and second spikes concentrate pressure applied to said upper surface of said base member by a metatarsal head area of said person's foot so that said spikes penetrate such a forefoot portion insole of such a style shoe.

19. The orthotic insert of claim 13, wherein said base member is configured to be removably placed in a normal shoe having a relatively shallowly downcurved arch portion so that said person's foot is not plantarflexed by such a shoe, and said selected U-shaped ridge which extends downwardly by a greater distance than said other ridge is said inner ridge, so that said inner ridge engages an insole of such a shoe so as to permit a controlled amount of side-to-side rocking of said heel portion of said insert as said person walks, said outer U-shaped ridge extending downwardly from said lower surface of said base member by a sufficient distance that said outer ridge engages such an insole as said heel portion of said insert rocks from side-to-side so as to limit such rocking to within said controlled amount.

20. A removable unitary orthotic insert for a shoe, said insert having a forward to rear lengthwise axis defining medial and lateral sides thereof and comprising:

a substantially rigid base member having a rearwardly located heel portion forming a concave heel seat, and a longitudinally extending curved arch portion, and outer and inner substantially parallel, spaced apart U-shaped rigid ridges, a selected one of said parallel ridges projecting downwardly a greater distance below said lower surface of said heel portion of said base member than the other parallel ridge, said selected one of said ridges having a sharply-pointed lower edge which projects downwardly from said lower surface of said base member for penetrating into an upper surface of an insole of a shoe so as to maintain said insert in a fixed position therein, and for supporting said lower surface of said base member underneath said concave heel seat a spaced distance above such an insole, said ridge having sufficient rigidity to support said heel portion of said base member under a person's foot without significant collapse of said ridge;

said U-shaped rigid ridges extending substantially continuously around the rearward end of said heel portion and generally longitudinally along said arch portion on both said medial and lateral sides of said lengthwise axis, so that said angular orientation in which said foot is positioned by said orthotic insert is selectively adjustable in generally medial, lateral, and rearward directions by incremental removal of material from corresponding portions of said selected one of said ridges.

21. The orthotic insert of claim 20 wherein said base member is configured to be removably placed in a style shoe having an insole having a relatively steeply downcurved arch portion, so that said foot of said person is plantarflexed when placed in such a style shoe, and said outer ridge is said selected ridge which projects downwardly from said lower surface of said heel portion of said base member by a greater distance than said inner ridge, so that said heel portion of said base member is stabilized against side-to-side rocking by engagement of said outer ridge with an insole of a style shoe.

22. The orthotic insert of claim 21, wherein said base member further comprises a forwardly located forefoot portion having a lower surface and an upper surface for supporting a forefoot portion of a person's foot.

23. The orthotic insert of claim 22 comprising at least one spike formed on said lower surface of said forefoot portion of said base member, said spike having a sharply pointed lower end for penetrating into an upper surface of an insole so as to maintain said forefoot portion of said orthotic insert in a longitudinally fixed position in a shoe when weight is applied to an upper surface of said base member by a person's foot.

24. The orthotic insert of claim 23, wherein said at least one spike comprises first and second spikes located proximate a rearward end of said forefoot portion of said base member.

25. The orthotic insert of claim 24, wherein said curved arch portion of said base member has a curvature which exceeds that of a curved arch portion of a style shoe insole, so that a gap is formed intermediate said lower surface of said base member and an upper surface of an arch portion of an insole when said insert is placed in a style shoe.

26. The orthotic insert of claim 25, further comprising thickened portions of said base member intermediate said parallel ridges in said arch portion of said base member, for providing said arch portion of said base member with relatively greater strength and resilience to flexing.

27. The orthotic insert of claim 20, wherein said base member is configured to be removably placed in a normal shoe having a relatively shallowly curved arch portion, and said inner ridge is said selected one of said ridges which projects downwardly from said lower surface of said heel portion of said base member by a greater distance than does said outer ridge, so that engagement of an insole of a normal shoe permits a controlled amount of side-to-side rocking of said heel portion of said insert.

* * * * *